US005572758A

United States Patent [19]

Merritt

[11] Patent Number: 5,572,758

[45] Date of Patent: Nov. 12, 1996

[54] COMBINATION SEAT CUSHION AND CHEERING AID

[76] Inventor: Thomas C. Merritt, 1619 Clarendon, Longview, Tex. 75601

[21] Appl. No.: 447,188

[22] Filed: May 22, 1995

Related U.S. Application Data

[63] Continuation of Ser. No. 221,032, Mar. 29, 1994, abandoned, which is a continuation of Ser. No. 24,536, Mar. 1, 1993, abandoned, which is a continuation of Ser. No. 600,225, Oct. 19, 1990, Pat. No. Des. 336,200.

[51] Int. Cl.[6] ..... A47C 16/00

[52] U.S. Cl. ..... 5/653; 5/420; 5/656; 5/907

[58] Field of Search ..... 5/420, 653, 656, 5/662, 907, 466; 4/581, 586

[56] References Cited

U.S. PATENT DOCUMENTS

| | | | |
|---|---|---|---|
| 2,061,664 | 11/1936 | Lincoln | 5/474 |
| 2,097,805 | 11/1937 | Walsh | 40/586 |
| 3,323,151 | 6/1967 | Lerman | 5/465 |
| 3,363,272 | 1/1968 | Channon | 5/656 X |
| 3,938,569 | 2/1976 | Hill | 5/653 X |
| 4,441,271 | 4/1984 | Hutchinson | 40/584 |
| 4,637,151 | 1/1987 | Love et al. | 40/584 |
| 4,925,241 | 5/1990 | Geraci | 297/229 |
| 5,022,107 | 6/1991 | Knotts | 5/420 X |
| 5,120,111 | 6/1992 | Cook | 5/507.1 X |

FOREIGN PATENT DOCUMENTS

| | | | |
|---|---|---|---|
| 1199533 | 7/1970 | United Kingdom | 5/638 |

*Primary Examiner*—Micahel F. Trettel
*Attorney, Agent, or Firm*—Morgan L. Crow, P.E.

[57] ABSTRACT

This invention is a combination seat cushion for use for example at sporting events or contests. A hand hole is provided which makes the cushion convenient to carry to and from a sporting or other event. In order to demonstrate enthusiasm for a particular contestant or team, the item is held overhead for use as a portable, handheld display sign or billboard. An imprint might be used for showing support for a particular race car and driver. The faces of the cushion may be imprinted with insignia of a team such as a university or professional football team. An imprint might be used to show support for a ball team. An alternate embodiment has a hand hole adapted to receive a beverage cup. An alternate embodiment is useful for display of a long word or a series of words wherein the long dimensions of the cushion and display are horizontal. Another alternate embodiment is elongated for use by two or more users.

5 Claims, 4 Drawing Sheets

COMBINATION SEAT CUSHION AND CHEERING AID

CROSS REFERENCE TO RELATED APPLICATION

This application is a continuation of application Ser. No. 08/221,032, filed Mar. 29, 1994, now abandoned, which is a continuation of the patent application COMBINATION SEAT CUSHION AND CHEERING AID Ser. No. 08/024,536 filed Mar. 1, 1993, now abandoned, which is a continuation of Design patent application COMBINATION SEAT CUSHION AND CHEERING AID Ser. No. 07/600,225, filed Oct. 19, 1990, now U.S. Pat. No. Des. 336,200.

BACKGROUND OF THE INVENTION

1. The Field of the Invention

This invention relates to the field of portable seat cushion which also serve the purpose of a cheering aid, and portable hand held billboard, also an embodiment serves in addition as a beverage holder.

2. Related Prior Art

The Related Prior Art In U.S. Pat. No. 4,441,271 issued to Earl Hutchinson teaches the use of a portable seat cushion, pennant and noisemaker combination comprising a foldable carrying case having two separate pockets folding one over the other, a block of cushioning material in each of the pockets each of the blocks of cushioning material including display features thereon and surface areas capable of producing an audible sound when slapped together. Hutchinson also teaches the use of the seat cushions as pennants when held in the user's hands. No hand hole provision is provided.

The Related Prior Art In U.S. Pat. No. 4,788,728 issued to Kerry L. Lake teaches the use of a Pillow with central aperture. Embodiments are illustrated for bed pillows for supporting the user's head while sleeping. These embodiments have apertures extending through the pillows for the purpose of relieving pressure on the user's face and ears. The proportions and illustrations would not be adaptable to the use of these apertures as hand holds, since even an adult's hand would not reach around any portion of the pillow adjacent the aperture.

The Related Prior Art In U.S. Pat. No. 4,925,241 issued to Ronald J. Geraci teaches the use of a pair of flexible enclosures joined by flexible means and a handle attached to the flexible means for facilitating the carrying of the cushion apparatus. The insignia illustrated would right side up when carrying the apparatus while walking or standing. The handle is attached to the flexible means. It is obvious to a person of ordinary skill that the cushions could not be held above the head with the user's arm extended upwardly.

SUMMARY OF THE INVENTION

A combination seat cushion and cheering aid and portable outdoor billboard comprising a resilient cushion having an obverse or front face and a reverse face, each of the faces bounded by an edge, a hand hole of generally rectangular shape extending through the faces of the cushion, the hole positioned near the edge and adapted to receive a user's hand for gripping the cushion and insignia oriented with the bottom side of the insignia toward the hand hole. The cushion is of generally rectangular shape, the edges having longer and shorter sides. The hand hole may be convoluted to receive the user's fingers for gripping the cushion. An alternate embodiment is also a beverage holder. Another alternate embodiment is adapted for simultaneous use by two or more persons.

DESCRIPTION OF THE PREFERRED EMBODIMENT

This invention is a combination seat cushion for use, for example, at sporting events or contests. The hand hole makes the cushion convenient to carry to and from the event. In order to demonstrate enthusiasm for a particular contestant or team, the item is held overhead for use as a display sign. The user may place the cushion on the seat for comfort while seated. When the user desires to stand and cheer, the seat cushion may be grasped at the hand hole and raised above the user's head to show the insignia properly oriented, right side up and readable as a cheering aid, portable outdoor or indoor billboard to cheer on a contestant or team and to show support for the contestant or team to the others attending the event, or for advertising.

Figure 1:
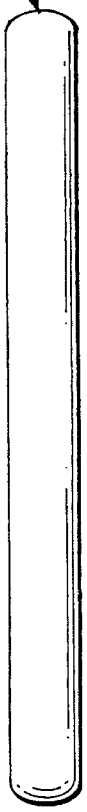
FIG. 1 is an edge view of the invention.

FIG. 1 illustrates the cushion 10 from the edge to show the configuration of the cushion as adaptable for use as a cushion. The cushion is preferably of a resilient foam construction with a smooth impervious integral surface that prevents absorption of water or other liquids in case of rain or spillage of a beverage.

Figure 2:
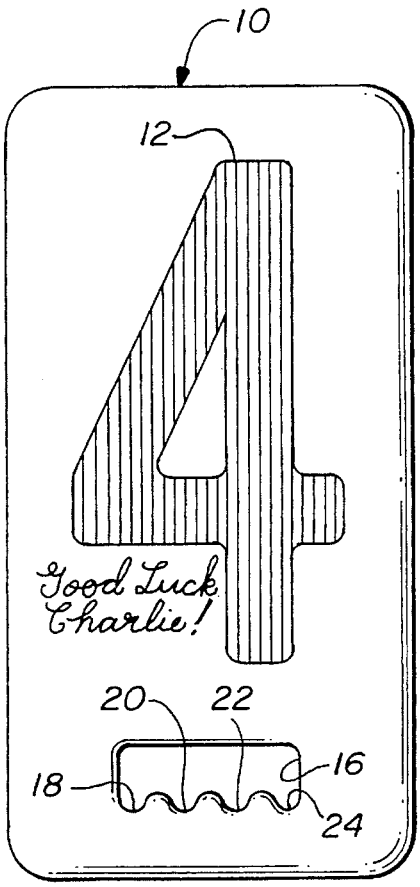
FIG. 2 is an obverse face view of the invention.

FIG. 2 illustrates the imprint as might be used for showing support, for example, for a particular race car and driver. The faces of the cushion may be imprinted with insignia of a team such as a university or professional football team. The "4" imprint 12 could be the car number of a driver "Charlie." An encouraging statement 14 could be imprinted. These insignia could also be used to encourage a football, baseball or hockey player with the appropriate player number and name. A hand hole 16 provides the means to hold the cushion overhead,with the insignia right side up, and readable, while cheering for the individual or team the user wishes to encourage. The hand hole of generally rectangular shape, but preferably provided with depressions 18, 20, 22 and 24 provided for the user's fingers to provide a secure grip on the cushion. The depressions are preferred, but are optional and are not necessary to the invention. The hand hole may also be of oval, semicircular, semioval or other shape, so long as the size and shape facilitate grasping of the cushion with the user's fingers positioned through the hand hole. Orientation of the insignia is with the bottom of the insignia toward the hand hole, so the insignia is right side up, and readable, while the cushion is held overhead with the user's uplifted arm. Other spectators and possibly the contestant being cheered may see the insignia indicating support for the individual or team indicated by the insignia.

DESCRIPTION OF ALTERNATE EMBODIMENTS

Figure 3:
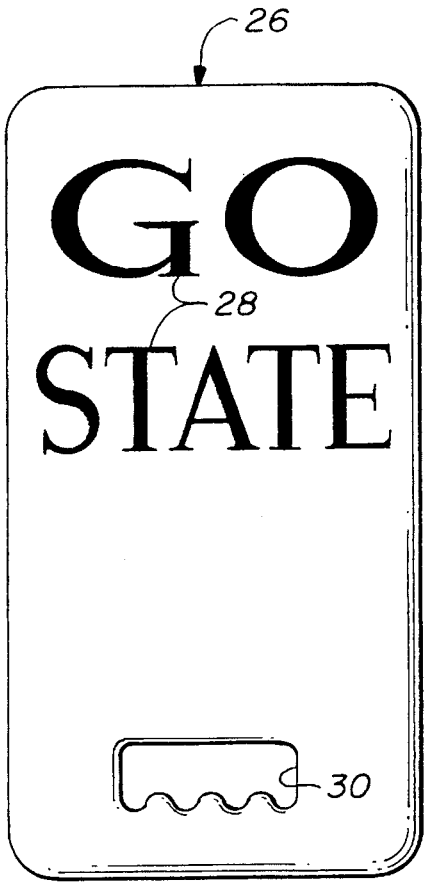
FIG. 3 is a reverse face view of the invention.

FIG. 3 illustrates an embodiment 26 of the invention with an imprint 28 as might be used to show support for a ball team. In use, specific names of school, college, university and professional teams could be used. The hand hole 30 is the same as hand hole 16 described in FIG. 2.

Figure 4:
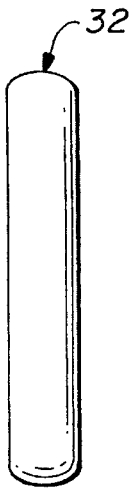
FIG. 4 is an edge view of an alternate embodiment.

FIG. 4 is an edge view of an alternate embodiment 32.

Figure 5:
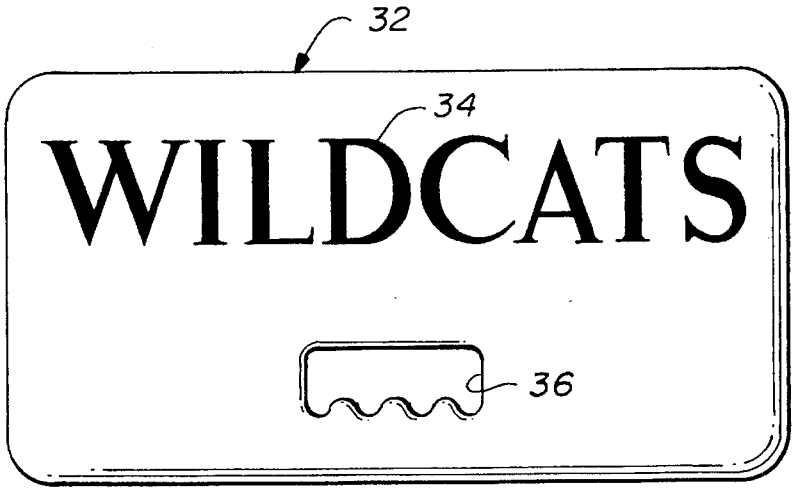
FIG. 5 is an obverse face view of an alternate embodiment of FIG. 4.

FIG. 5 is an obverse or front face view of the alternate embodiment 32 of FIG. 4, and illustrates an embodiment which is useful for display of a long insignia or word 34 or a series of words where the long dimension of the display is desired to be horizontal. In this embodiment, which is generally rectangular with two longer and two shorter sides, the hand hole 36 is positioned near the center of a long side of the cushion. Hand hole 36 is the same as hand hole 16 described in FIG. 2. Orientation of the insignia is with the bottom of the insignia 34 toward the hand hole 36, so the insignia is right side up, and readable, while the cushion is held overhead with the user's uplifted arm.

Figure 6:
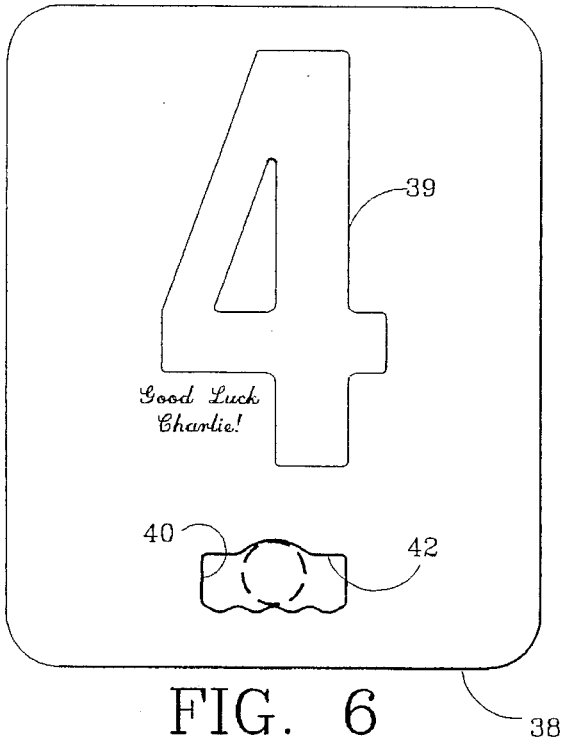
FIG. 6 is an obverse face view of another alternate embodiment of the invention.
Figure 7:
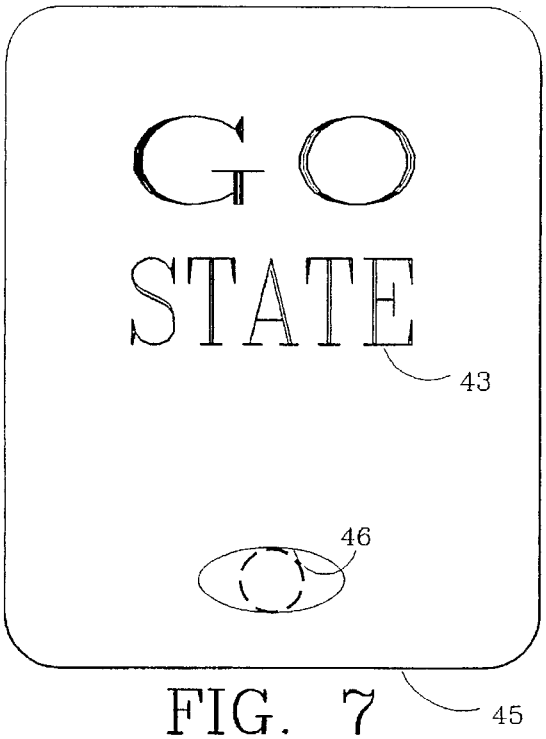
FIG. 7 is still another alternate embodiment of the invention.
Figure 8:
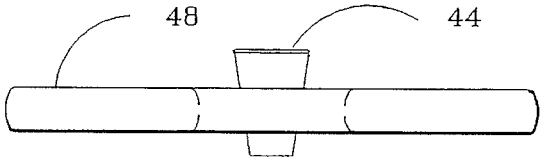
FIG. 8 is an edge view of the embodiments shown in FIGS. 6 and 7.
Figure 9:
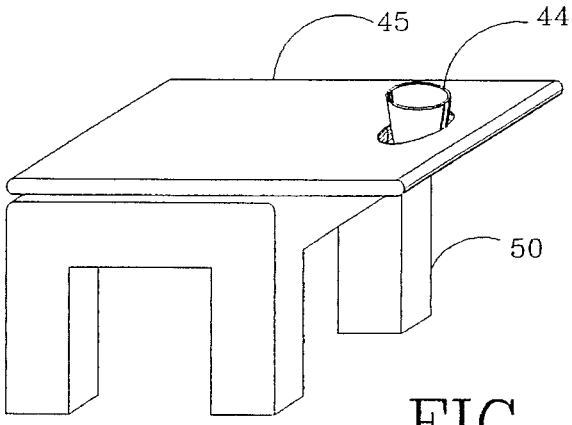
FIG. 9 is a view of the embodiment of FIG. 7 positioned for use.

FIGS. 6, 8, and 9 illustrate an alternate embodiment 38 which is useful as a cushion and a cheering aid as embodiments described hereinbefore. FIG. 6 illustrates an embodiment which has the hand hole 40 enlarged at 42 so as to accept a disposable beverage cup 44 as illustrated in FIG. 8. Since disposable beverage cups are usually tapered, a hole width intermediate the smaller and larger diameters of the beverage cup will support a typical beverage cup. An insignia 39, is positioned and oriented so that is seen right side up and readable when held overhead by a user. Referring to FIG. 7, the cushion 45 has hand hole 46 illustrated as an oval shape, and an insignia 43, positioned and oriented so that is seen right side up and readable when held overhead by a user. The hand hole 46 is sized across the small dimension so as to accept and support a typical size disposable beverage cup. FIG. 8 illustrates the cushion 48 and the use of alternate embodiments 38 or 45 shown in FIGS. 6 and 7, respectively. FIG. 9 shows a seat 50 and cushion 45 in place on the seat. The hand hole 46 is positioned so the user can place a beverage container in the hand hole 46. The user's hands are then free from holding the beverage container so the user can pay for beverages and/or food. Both the user's hands are then free to eat food or for other purposes.

Figure 10:
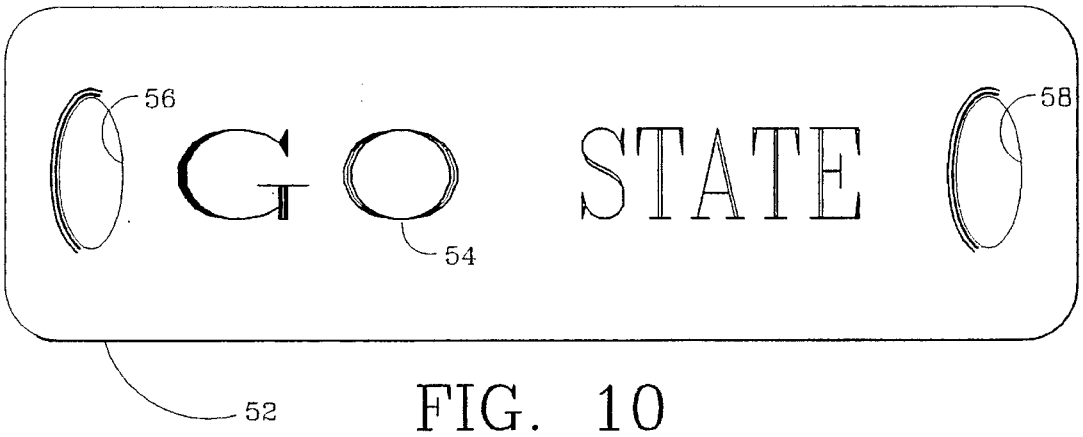
FIG. 10 is an obverse view of still another embodiment of the invention.
Figure 11:
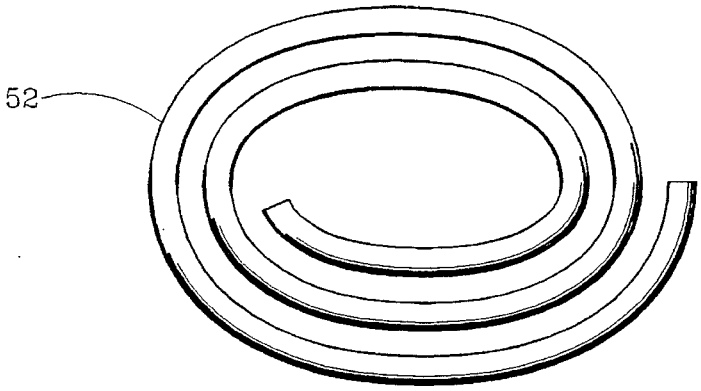
FIG. 11 is an edge view of the embodiment shown in FIG. 10 rolled to carry.

Referring to FIGS. 10 and 11, an elongated cushion 52 may be used as a cushion for two or more people on a bench type seat. A cheering aid insignia 54 is placed on the cushion. Hand holes 56 and 58 aid in holding the cushion overhead to show support for a participant in the event, or to convey a message or advertisement.

Figure 12:
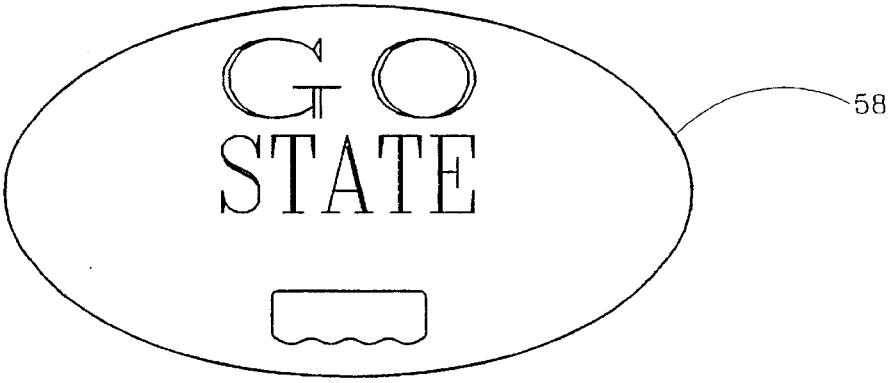
FIG. 12 is an obverse view of still another embodiment of the invention.

Referring to FIG. 12, an oval shape combination cheering aid and cushion 58 is illustrated. This embodiment has insignia and a hand hole as described hereinbefore.

Figure 13:
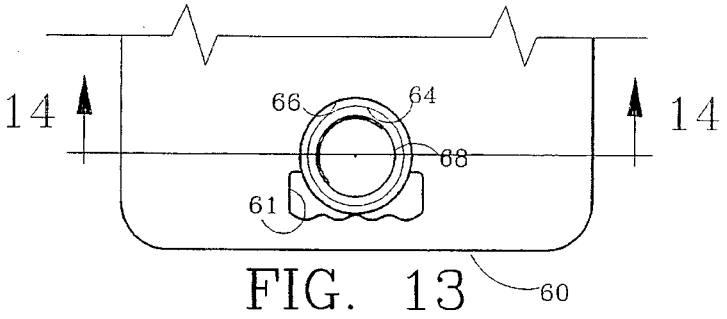
FIG. 13 is a partial obverse view of still another embodiment of the invention.
Figure 14:
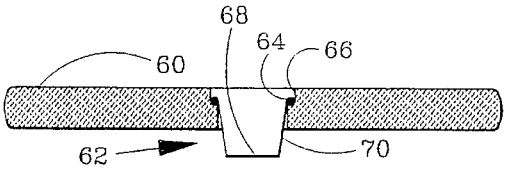
FIG. 14 is an section view of the embodiment of FIG. 13 through the section line 14—14 in FIG. 13.
Figure 15:
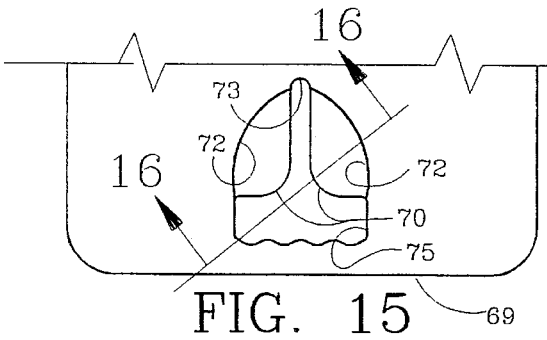
FIG. 15 is a partial obverse view of still another embodiment of the invention.

Referring to FIGS. 13 and 14, an alternate embodiment 60 is shown which is also a beverage holder in addition to being a combination cushion and cheering aid. FIGS. 13 and 14 illustrate an improved combination beverage holder, cushion and cheering aid 60. A beverage holder insert is shown generally at 62. The insert 62 has a top ring 64 which seats in a molded receptacle 66 molded in the cushion 60. The insert 62 has a bottom 68 of rigid material such as plastic. The ring 64 and bottom 68 are connected by a flexible sleeve 70.

Figure 17:
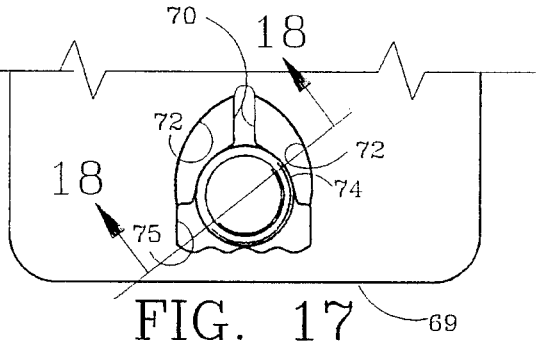
FIG. 17 is a partial obverse view of the embodiment of FIG. 15 gripping a beverage container.
Figure 16:
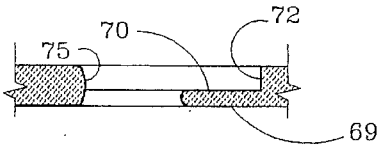
FIG. 16 is an partial section of the embodiment of FIG. 15 through the section line 16—16 in FIG. 15.
Figure 18:
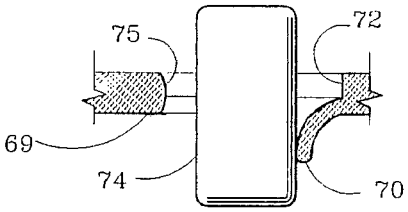
FIG. 18 is an partial section of the embodiment of FIG. 15 along the section line 18—18 in FIG. 17 gripping a beverage container.

Referring to FIGS. 15, 16, 17 and 18, cushion 69 which is still another embodiment of the invention is illustrated. Tabs 70 illustrated in the referenced Figures are provided, extending from as far as the boundary 72 in FIGS. 15 and 17. The tabs 70 extend into the hand hole 75. A slot 73 separates and defines the tabs 70 to allow flexibility of the tabs 70. A beverage cup or can 74 may be pushed into hand hole as illustrated in FIGS. 17 and 18. Tabs 70 are deformed as illustrated in FIGS. 17 and 18 to grip and hold the beverage container, to free the user's hands. The embodiment can have a single tab extending into the hand hole, or two tabs 70 as shown in FIGS. 15 through 18. The tab or tabs 70 should desirably be positioned to interfere with a 2 inch diameter container, to grip this size cup or can. The tab or tabs should desirably be long enough to deflect and allow insertion of a 3 inch diameter container. Some larger containers such as coffee mugs and larger plastic soft drink bottles may be as large as 4 inches in diameter and should be accommodated in some models.

USE OF THE PREFERRED EMBODIMENT

The preferred embodiment as illustrated in FIGS. 1, 2 and 3 is useful as a cushion to be carried to sporting events such as football, baseball, car races and the like. The cushion can be carried easily with a convenient hand hole. The invention may be used easily as a cushion in the conventional manner. When the user desires to cheer for a particular participant in the sporting event, the user may stand and grasp the cushion with the hand hole and hold the cushion overhead, where the insignia will be positioned to read correctly to others present at the event. Experimental cushions have been manufactured on order of the inventor and have been received enthusiastically by people who have the invention as tests at sporting events.

USE OF THE ALTERNATE EMBODIMENTS

The alternate embodiment illustrated in FIGS. 4 and 5 is used in the same manner as the preferred embodiment, except that the hand hole is positioned to orient the cushion with a the long dimension in a horizontal attitude, allowing a long insignia to be positioned so as to be read with the insignia with the right side up, and readable, when the cushion is held overhead by the user.

The alternate embodiments as in FIGS. 6, 7, 8 and 9 are useful as combination cushions and cheering aids as the embodiments illustrated in FIGS. 1 through 5. These embodiments are useful in addition as beverage holders. These embodiments each have a hand hole with an enlarged minimum dimension adapted to accept a beverage cup 44 so the invention also can act as a beverage holder. In use, the user of a cushion such as 38 or 45 could place the cushion on a seat as illustrated in FIG. 9. The user would desirably wear pants, or in case of a female user, she could possibly wear a short skirt. A beverage cup 44 could be placed in the hand hole 40, or 46 in case of use of a cushion 38 or 45. As the user sits on the cushion with the hand hole positioned between the user's legs, the hand hole provides a convenient receptacle for a beverage cup. The inventor has determined that the hand hole desirably has a minimum dimension in the range of substantially 2 inches to substantially 2.5 inches whereby the beverage cup 44 may be supported while the cushion is positioned in a substantially horizontal plane, as when the cushion is placed on a seat as illustrated in FIG. 9. A cup holder insert may be inserted in the hand hole which to accept and support a wide range of sizes of beverage cups.

The alternate embodiment illustrated in FIGS. 10 and 11 may be rolled up as illustrated in FIG. 11. A strap may be used to hold the cushion in a roll to be conveniently carried to the site of use. The cushion may then be unrolled and placed on a stadium seat or the like to serve as a cushion for two or more people. When it is desired to use the cushion as a cheering aid, the users can stand and hold the cushion overhead to signify support for a participant in the event. In addition, the cushion is also useful on a picnic table, as for example at a park for a picnic.

Referring to FIGS. 10 and 11, the cushion 52 may be rolled for convenience to carry a cushion for at least two people to the destination. A strap (not shown) may be used to hold the cushion in a roll as illustrated in FIG. 11. At the destination, the cushion may be unrolled and placed on a bench type seat for the use and comfort of two or more users. When desired, the users may stand and two or more users can lift the cushion overhead to signify support for a participant in the event. In addition, the cushion is also useful on a picnic table, for example at a park for a picnic. Average bench width occupied by people is about 18 inches. A single cushion of about 15 inches length will serve comfortably for one person. A cushion for two people would need to be at least substantially 30 inches in length to provide a cushion for two people seated side by side. The front to back dimension of a cushion can be as little as about 8 inches to provide a reasonably comfortable cushion that is still small enough to carry conveniently.

Referring to FIGS. 15, 16, 17 and 18, there is shown still another embodiment of the invention. One or more tabs should be provided for interference with and to grip various sizes beverage containers. The user can place the cushion in the seat with the hand hole in front of the user, between the user's legs. The user can place a beverage container in the hand hole and push down to deflect the tab or tabs 70 which will exert enough force against the container to support the container. The user can simply grasp the container and pull upwardly to drink from the container, or to dispose of the container.

For purposes of this specification, insignia comprise advertising, one or more words designating the individual or team being supported, one or more slogans and one or more drawings including logotypes, advertisements, or pictorial representations of mascots and the like; and combinations of one or more of the foregoing. For purposes of this specification, beverage cup comprises cups, mugs, cans, bottles and other kinds of beverage containers.

This specification includes a combination seat cushion and cheering aid comprising a resilient cushion having an obverse i.e. front face and a reverse face, each of the faces bounded by an edge, an elongate hand hole extending through the faces of the cushion, the hole positioned near the edge and adapted to receive a user's hand for gripping the cushion, insignia on at least one of the faces oriented with the bottom side of the insignia toward the hand hole. I include the feature wherein the cushion which is of generally rectangular shape, the edges having two longer and two shorter sides. A variation includes the hand hole is being convoluted as shown in FIG. 2 to receive the user's fingers for gripping the cushion. The hand hole may be positioned near the midpoint of one of the shorter side, to have a tall cheering aid. The hand hole may also be positioned near the midpoint of one of the longer sides. The hand hole may be positioned near the midpoint of one of the longer sides. This provides a wide format sign for a long word or drawing in the insignia. The insignia may be provided on each of the faces, the insignia oriented with the bottom side of the insignia toward the hand hole on each face. Combination seat cushions and cheering aids with insignia oriented with the hand hole below the makes the cheering aid effective and convenient for grasping the cushion with the user's fingers in the hand hole and holding the cushion over the user's head. The insignia is right side up when applied according to this invention. FIGS. 2, 3, 5, 6, 7 and 10 illustrate insignia containing words and numbers. The insignia are illustrated right side up as defined for purposes of this specification. Therefore, the bottom of the insignia is positioned nearest the hand hole, by definition for purposes of this specification. The hand holes illustrated in FIGS. 2 through 7 illustrate insignia which will be positioned right side up, and therefore readable, when the cushion is grasped by the hand in the hand hole and held overhead by the user.

FIG. 12 is another embodiment of the invention utilizing an oval shape.

FIGS. 13 and 14 illustrate a combination beverage holder, cushion and cheering aid. The additional feature of this embodiment is the insert 62 which can support a small or large beverage cup. The advantage is that a support is provided for the bottom of a cup in a wide range of dimensions. The insert supports a beverage container on the bottom 68 in the insert 62. The flexible sleeve 70 can collapse to allow easy stacking or transportation of the cushion.

FIGS. 15, 16, 17 and 18 illustrate a combination beverage holder, cushion and cheering aid. The integral flexible tabs 70 are of sufficient cantilevered dimension and reduced thickness compared to the cushion to provide the flexibility to deform easily enough to deform easily when a paper or plastic cup or aluminum can is pushed into the hand hole to deform the tabs 70 as illustrated in FIG. 18. The tabs must be of sufficient strength to grip and support the beverage container.

Even though several embodiments of the invention have been illustrated in the accompanying drawings and described in the foregoing Description it will be understood that the invention is not limited to the embodiments disclosed, but is capable of rearrangements, modifications, and substitutions and reversals of parts and elements without departing from the spirit of the invention.

I claim:

1. A combination seat cushion, cheering aid, and beverage holder comprising:

a resilient cushion having an obverse side and a reverse side, the faces bounded by an edge, a hand hole extending through the faces, insignia, having a top and a bottom side, on at least one of the faces oriented with the bottom side of the insignia toward the hand hole, and at least one integral flexible tab extending into the hand hole, positioned to interfere with and grip a 2 inch diameter container inserted in the hand hole.

2. The apparatus of claim 1 having at least one flexible tab extending into the hand hole, positioned to interfere with and grip a 2 inch diameter container inserted in the hand hole, and to interfere with and grip a 4 inch diameter container inserted into the hand hole.

3. The apparatus of claim 1 having at least one flexible tab extending into the hand hole, positioned to interfere with and grip a 2 inch diameter container inserted in the hand hole, and to interfere with and grip a 5 inch diameter container inserted into the hand hole.

4. A combination seat cushion and beverage holder, comprising:

a resilient cushion having an obverse face and a reverse face, the face bounded by an edge, a hand hole extending through the faces, an insert having generally cylindrical shape and having a top and a bottom, with the bottom closed, and an external flange at the top, the flange sized to be inserted in and supported in said hand hole, the insert sized to accept and support a beverage cup.

5. The apparatus of claim 4 wherein said insert is tapered, smaller at the bottom and larger at the top.

* * * * *